United States Patent [19]

Brungard et al.

[11] 4,096,614

[45] Jun. 27, 1978

[54] METHOD AND APPARATUS FOR REMOVING STATOR VANES

[75] Inventors: Alvin J. Brungard, Greenhills; Richard M. Galloway; Donald P. Kerwick, both of Cincinnati, all of Ohio

[73] Assignee: General Electric Company, Cincinnati, Ohio

[21] Appl. No.: 609,601

[22] Filed: Sep. 2, 1975

[51] Int. Cl.[2] ..... B23P 15/04; B23P 19/02; B23P 19/04

[52] U.S. Cl. ..... 29/156.8 R; 29/427; 29/244; 29/267; 29/283

[58] Field of Search ..... 29/156.8 R, 427, 200 D, 29/239, 240, 244, 267, 275, 283, 23.5

[56] References Cited

U.S. PATENT DOCUMENTS

| | | | |
|---|---|---|---|
| 930,735 | 8/1909 | Dahl | 29/23.5 |
| 1,172,334 | 2/1916 | Williamson | 29/23.5 |
| 1,172,335 | 2/1916 | Williamson | 29/23.5 |
| 1,269,144 | 6/1918 | Williamson | 29/156.8 R |
| 2,130,478 | 9/1938 | Allard | 29/23.5 |
| 2,912,222 | 11/1959 | Wilkes, Jr. | 29/156.8 R |
| 3,673,668 | 7/1972 | Crook | 29/275 |

FOREIGN PATENT DOCUMENTS

| | | | |
|---|---|---|---|
| 1,104,875 | 4/1961 | Germany | 29/267 |

*Primary Examiner*—C.W. Lanham
*Assistant Examiner*—Daniel C. Crane
*Attorney, Agent, or Firm*—Dana F. Bigelow; Derek P. Lawrence

[57] ABSTRACT

A stator vane is removed from an arcuate casing by placing a conforming mold over the vane airfoil with portions thereof extending axially on either side of the airfoil to provide driving surfaces, and repetitiously imparting a precisely directed impact to the driving surfaces to move the vane circumferentially within the casing. Impact to the driving surfaces is made by way of an elongated arm which is supported at its one end so as to be pivotable about the axis of the casing, and whose other end is bifurcated to straddle the vane row and impinge against the driving surfaces. In this way the individual vanes may be removed from a single stage without incurring significant damage thereto and without removing any vanes of adjacent stages.

15 Claims, 7 Drawing Figures

METHOD AND APPARATUS FOR REMOVING STATOR VANES

The invention herein described was made in the course of or under a contract, or a subcontract thereunder, with the United States Department of the Air Force.

BACKGROUND OF THE INVENTION

This invention relates generally to turbomachinery stator vanes and, more particularly, to a method and apparatus for removal of stator vanes from their installed position with an arcuate casing.

In an axial flow compressor, wherein the airflow remains basically parallel to the rotational axis of the compressor, the compressor is built up of stages with each stage consisting of a row of rotating blades and a row of fixed stator blades or vanes. To accommodate the increasing pressures toward the later stages, the number and size of the rotor blades and vanes in each stage changes as the air passages are gradually diminished through the compressor. Since the performance and efficiency of a turbine compressor is dependent upon the precisional dimensioning and condition of the airfoils, it is inherent in the maintenance schedule of a turbine compressor to inspect and exchange airfoils as they become worn or damaged. One of the primary causes of damage to a compressor airfoil is that of foreign object damage (commonly referred to as FOD), which occurs when a foreign object such as a bird or the like is drawn into the compressor and impacts with the compressor blade or vane. When damage does occur, or when inspections identify weaknesses which could later cause failures, it may be necessary to remove and replace one or more blades and/or vanes. In order to replace either the rotor blades or the stator vanes, it is necessary to separate the two halves of the stator casing so as to allow removal of the compressor rotor. Replacement of a rotor blade, which is attached to one of a number of discs mounted on a central shaft, is then relatively easy since the stages can be separated and any one blade may be removed from its respective stage. In the case of the stator vanes, however, which are fixed to the inside of the compressor casing and therefore not easily accessible, replacement may be difficult especially if the interconnecting slots are corroded.

Stator casings are customarily constructed with a plurality of axially spaced T-slots with each T-slot adapted to circumferentially receive a plurality of vane platforms to make up the vane stage row. The stage rows, and therefore the T-slots, are necessarily closely spaced in the axial direction so that it is difficult to remove a single stage row without first removing the adjacent stage rows. Even after access is gained to the particular vane row at hand, removal of a vane may be particularly difficult when it is corroded by repeated collection of moisture within the casing.

The removal of corroded stator vanes from compressor stator casings has long been accomplished by driving them out with the use of a hammer and a brass or plastic drift pin, thereby often resulting in irrepairable damage to the vanes and, in many instances, to the stator casing. Another method which has been used is that of soaking the assembly in sonic baths of penetrants; however, this has not always been successful and even when successful tends to take an excessive amount of time. Yet another method of using hydraulic power sweeps has been applied but with very little success. Further, with the use of any of the prior art concepts, in order to remove an intermediate individual stage of vanes, it is generally necessary to remove, or at least disturb, the adjacent stages and possibly all of the stages within the casing.

It is therefore an object of this invention to provide an improved method for removing fixed stator vanes from a compressor casing.

Another object of this invention is the provision for removing corroded stator vanes while incurring minimum damage to the vanes and casing.

Yet another object of this invention is the provision for removing an individual stage of compressor vanes without disturbing the adjacent stages thereof.

Still another object of this invention is the provision for an economical and functional method of removing stator vanes from a compressor casing.

These objects and other features and advantages become more readily apparent upon reference to the following description when taken in conjunction with the appended drawings.

SUMMARY OF THE INVENTION

Briefly, in accordance with one aspect of the invention, a soft metal casting is fabricated to conform to and be slideable over the airfoil portion of the blade so as to rest on the platform portion thereof. A holder is attached to the casting so as to extend axially outwardly on either side of the blade to expose a substantially radially extending driving surface between the blade to be removed and each of the adjacent vane rows on either side thereof. The driving surfaces are then made to receive a series of impacts, directed in a substantially tangential direction, to drive the vane out of the T-shaped circumferential groove in the case. In this way, a single stage or portion thereof can be removed without disrupting the vane stages adjacent thereto.

In another aspect of the invention the impact delivering device comprises an arm which is pivotally disposed about the axis of the casing with its free end being bifurcated and extending toward the casing structure to straddle the vane row and impact against the driving surfaces when rotated about its axis.

In this way vanes may be individually removed, and if the corrosion thereon is not too severe, a plurality of vanes can be removed from a singled stage at the same time. To accommodate the removal of other stages within the stator casing, the arm is simply translated along its axis to the proper position. Since the vanes of the compressor are normally of decreasing size toward the later stages of a compressor, it is necessary to have different sizes of castings to establish a proper tight fit over the vane being removed. However, a single size casting may accommodate more than one vane row, even though the vanes within these rows are of slightly different size. Thus, it will be recognized that a number of different sized castings will be required to remove all of the rows within a casing, but the number required will not necessarily be equal to the total number of blade rows.

By yet another aspect of this invention the axle from which the arm is suspended is rotatably supported by a pair of base elements which straddle the stator casing and which are connected to either end thereof by way of bolts. In this way, the casing itself is held firmly in place while the vane is being removed by repeated impacts. A lever handle is connected to the bearing mounted axle in order to provide the pivotal action for the arm.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
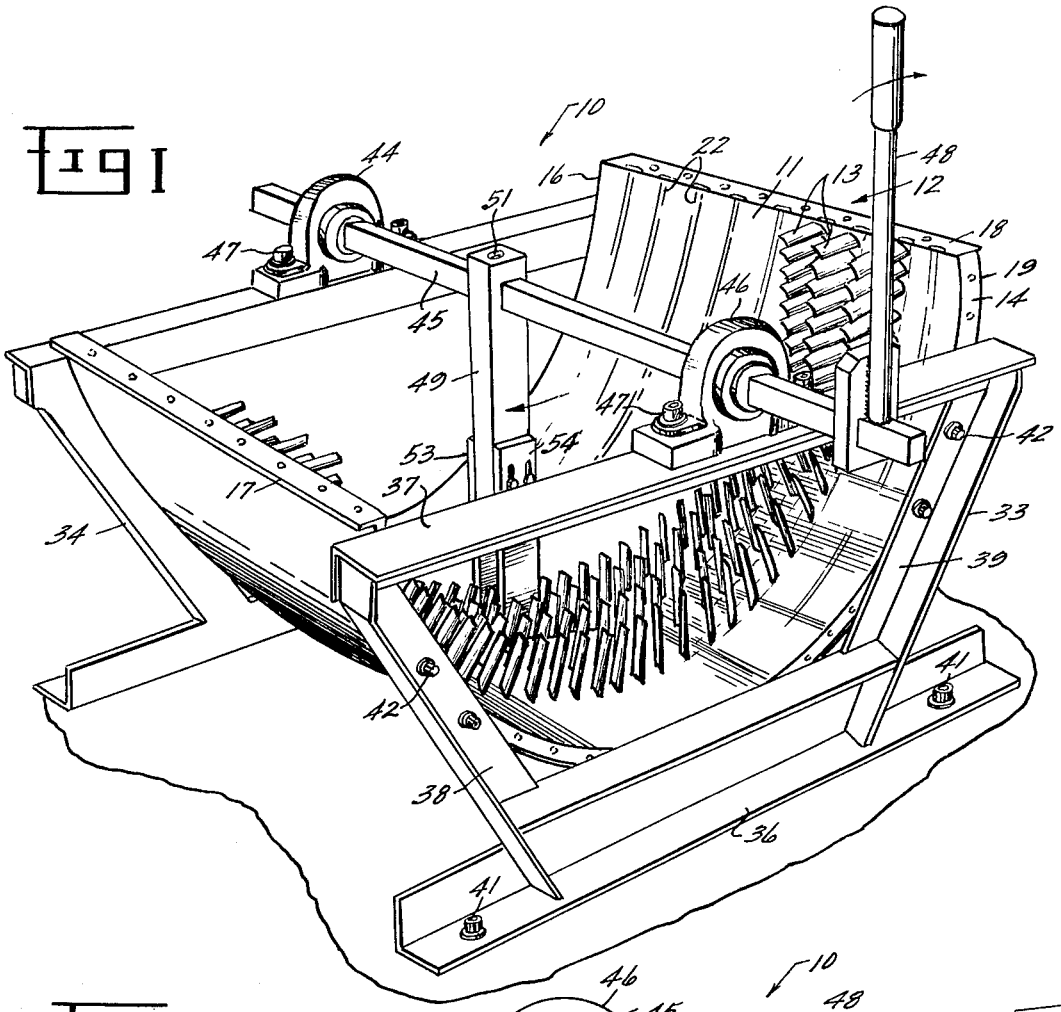
FIG. 1 is a perspective view of the blade removing apparatus as it is seen in attached relationship to a stator casing with installed vanes.
Figure 2:
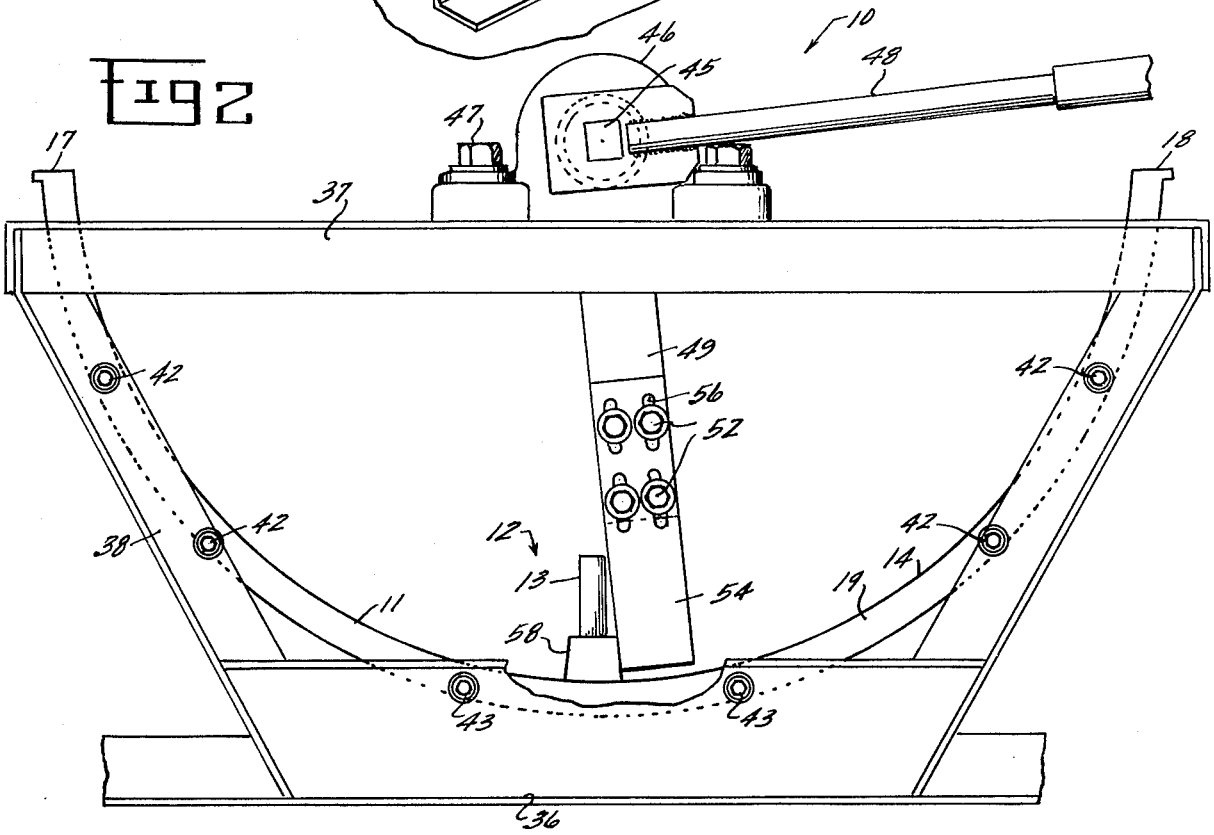
FIG. 2 is an end elevational view thereof with a portion of the apparatus broken away to show engagement of the device with a single vane to be removed.
Figure 3:
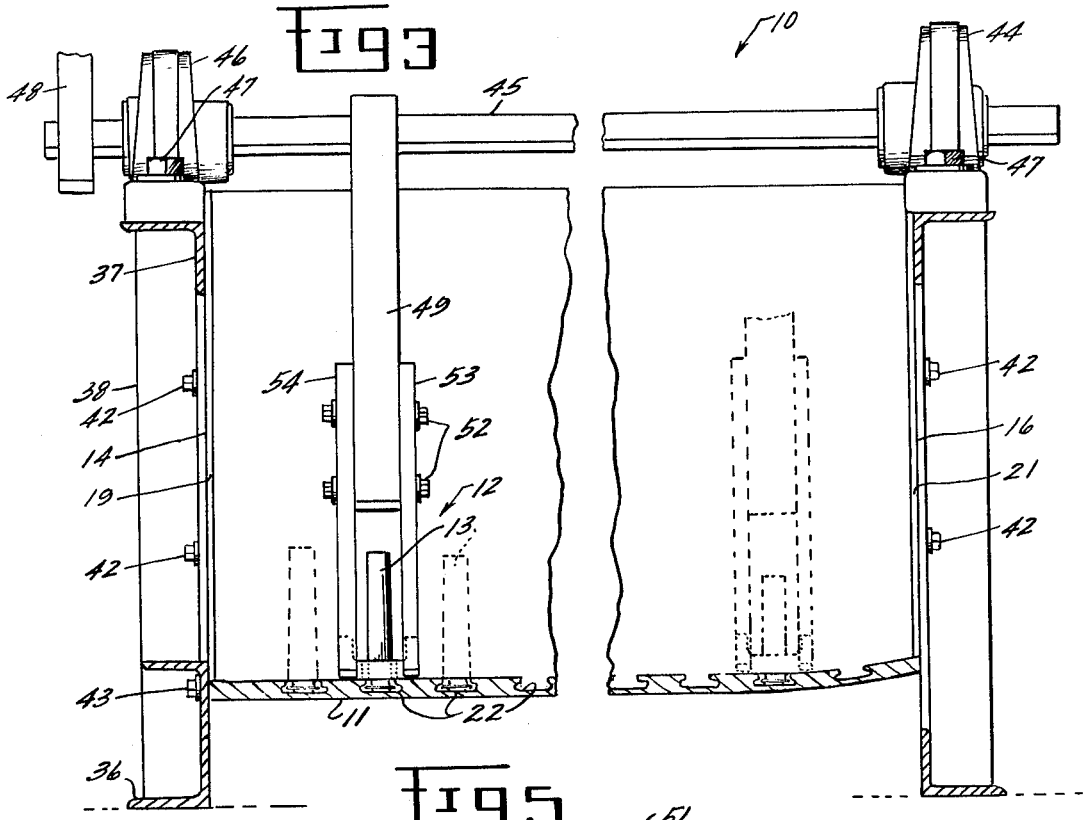
FIG. 3 is a longitudinal sectional view showing the arm portion thereof, in two different positions to accommodate two different vane rows.

Referring now to FIGS. 1 through 3, the inventive apparatus is shown generally at 10 as used in combination with an arcuate stator casing sector 11 having a plurality of axially spaced vane stages 12 installed therein as is well known in the art. Each stage is comprised of a plurality of circumferentially spaced, radially inwardly projecting vanes 13 of substantially the same size. However, the size and number of the vanes in differnt vane stages are different as is well known in the art. That is, as is seen in FIG. 3, the size of the blade decreases and the number of blades increases as these stages advance from the forward end 14 to the rear end 16 of the casing.

The casing sector 11 is in the form of a half-cylinder with apertured flanges 17 and 18 extending along the longitudinal edges thereof for joining a pair of such sectors to form a cylindrical compressor section. Attached to the ends 14 and 16 of the sector are the radially extending flanges 19 and 21, respectively, for joining the sector 11 to the axially adjacent portion of the engine, which may be another combustor casing sector.

Formed in the stator casing 11 is a plurality of axially spaced T-slots 22 extending circumferentially around the inner periphery of the sector 11 for slideably receiving the platform portion of the stator blades therein. Each of these T-slots is adapted to receive from either of the longitudinal extending edges, the blades for that individual stage, such blades being slid circumferentially into their proper positions such that the individual platforms abut the platforms of the adjacent vanes.

Figure 5:
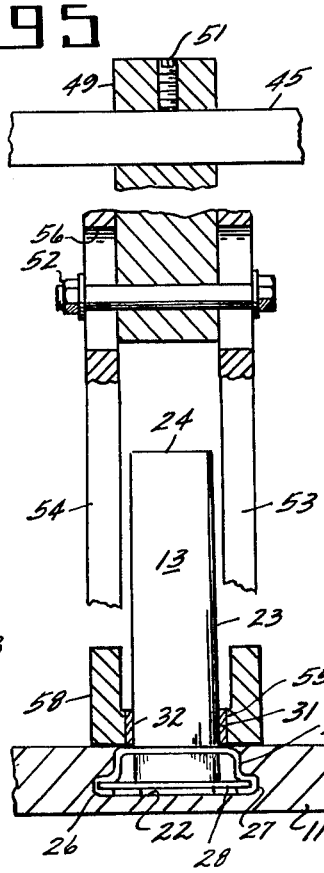
FIG. 5 is an enlarged sectional view of the arm and knocker portions thereof.
Figure 4:
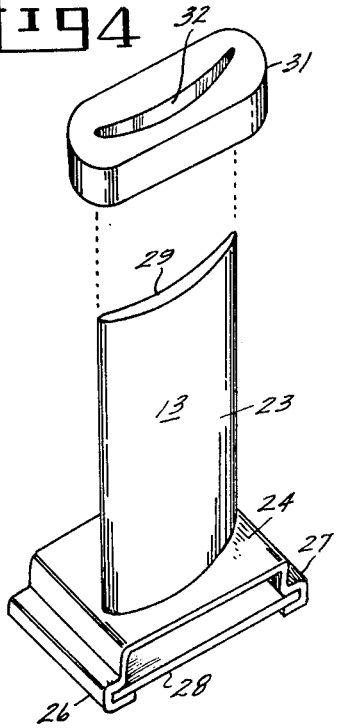
FIG. 4 is a perspective view of a stator vane and an associated conforming insert portion of the knocker assembly.

Referring now to FIG. 4, there is shown a vane structure which is of the type that is installed within the stator casing in the manner shown in FIG. 3. The blade 13 comprises an airfoil portion 23 which extends radially inwardly into the flow path of the air to be compressed, and a base or platform section 24 which is rigidly attached to the outward end thereof for rigid attachment to the stator casing. A pair of U-shaped flanges 26 and 27 are attached to opposite sides of the platform 24 and face each other to define a slot for receiving a plate 28 therebetween to complete the vane structure, which is installed and held in the stator casing in a manner shown in FIG. 5. As can be seen by FIGS. 3 through 5, the transverse cross-sectional shape of the blade is almost uniform from one end to the other, but there is a slight taper in size such that the free end 29 is slightly smaller than the other end which is attached to the platform. This tapering feature facilitates the placement over the blade of a molded soft metal insert 31 having a blade conforming hole 32 formed therein as will be more fully described hereinafter.

Referring now back to FIGS. 1 through 3, the apparatus of the present invention will be described. It comprises a pair of axially spaced trapezoidal base structures 33 and 34 standing in a generally upright manner and spaced appropriately such that the casing is disposable therebetween in close-fit relationship. Each of the base structures comprises lower and upper horizontal elements 36 and 37 and are connected by generally vertically extending cross elements 38 and 39. The lower horizontal elements 36 are connected by bolts 41 to the floor or other supporting structure, and the cross elements 38 and 39 have holes formed therein at the appropriate places to facilitate the insertion of bolts 42 therein to connect the base structure to the forward and rearward flanges 19 and 21 of the casing to stabilize it during the process of removing the vanes. The flanges 19 may also be connected to the lower horizontal element 36 by way of bolts 43 (FIG. 2). A pair of journaled pillow blocks 44 and 46 are mounted on the upper horizontal elements 37 of the base elements 33 and 34, by way of a plurality of bolts 47, and a square axle 45 extends therebetween and is supported thereby so as to coincide with the axis of the casing sector 11. Attached to one end of the axle 45 which extends through the pillow block 46 is a lever handle 48 for rotating the axle 45 within the journaled pillow blocks 44 and 46. An elongate arm 49 has a hole formed in one end thereof so as to fit over the axle 45 and be pivotably supported thereby. A set screw 51 is installed in the upper end of the pivot arm so as to allow the pivot arm to be slid axially to the appropriate position on the axis, and then set to this position for the operation of the apparatus in removing the particular stage of vanes. Near the other end of the pivot arm 49, or the free end, there is provided on either side thereof, corresponding to the axial ends of the apparatus, a plurality of bolts 52 for securing to the sides of the pivot arm 49, in axially spaced relationship, a pair of knocker plates 53 and 54, each plate having elongate holes 56 formed therein so as to be radially adjustable in its connection with the pivotal arm 49. For the present operation it is desirable that the combination radial length of the pivot arm 49 and the knocker plates be such that the free end 57 of the knocker plates be close to, but far enough from, the casing inner periphery to be freely rotated therein as shown in FIG. 2.

The axial width of the pivot arm 49, and thus the distance between the knocker plates 53 and 54, is necessarily greater than the axial width of the vanes 13, so that when the pivot arm 49 is adjusted to the proper axial position on the axle 45, the knocker plates 53 and 54 will straddle the particular vane or vane row to be removed as is shown in FIG. 5.

Figure 6:
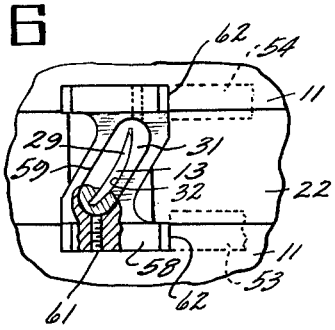
FIG. 6 is an end view thereof showing mutual engagement of the arm and knocker portions thereof.
Figure 7:
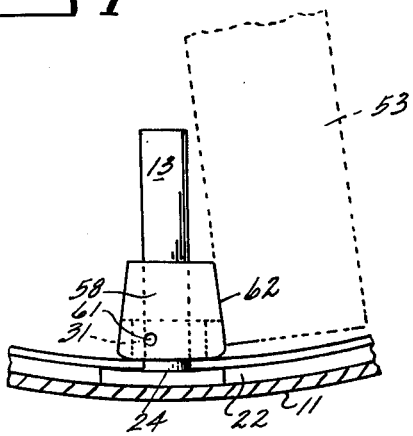
FIG. 7 is a fragmentary view of the knocker portion of the apparatus in the installed position with a portion thereof broken away for clarity.

Referring now to FIGS. 5, 6 and 7, attention is directed to the soft metal insert 31 which fits over the vane end 29 and is slid down the length of the blade to the base section thereof where it rests against the platform 24. The insert 31 is disposed in a holder 58 having a cavity 59 formed therein for receiving the insert, which is preferably cast therein, using the proper sized vane as a form. The insert 31 may then be secured within the holder by way of one or more set screws 61 as shown in FIG. 6. The holder 58 is generally U-shaped in form and extends upwardly from that portion surrounding the insert 31 to present a pair of substantially radially aligned striking surfaces 62, against which the knocker plates 53 and 54 are designed to repetitively strike with sufficient impact to move a particular blade around a circumferential T-slot 22 by way of successively transmitting the force through the holder 58, the insert 31, and the vane airfoil 23.

The procedure to be followed for removing a stator vane is as follows. First, the insert 31 is formed from a soft eutectic metal by positioning a vane of the proper size within the cavity 59 of the holder 58 and, while maintaining the sides of the insert holder square with the vane platform, filling the space therebetween with the metal to form a casting. Since the purpose of the insert is to distribute and transmit driving forces through the vane airfoil into the vane platform as close to the platform as possible, the insert should be molded in direct contact with the vane platform as shown in FIG. 5. Since the size of the vane varies from stage to stage, it may be necessary to form a different insert for each stage of the vanes; however, an insert may be usable for more than one stage if the airfoil patterns are similar in shape and close in dimension. Next, the base structures 33 and 34 are placed on either side of the casing at hand and are bolted to the flanges on the ends thereof with the interconnecting axle disposed on the axis of the casing as shown in FIG. 1. The pivot arm is then axially translated to the proper position for the particular vane stage, and the knocker plates 53 and 54 are adjusted to the proper radial position such that they closely clear the casing when rotated within the casing sector. The holder and insert assembly is then placed on the first vane nearest either of the open end flanges 17 or 18, with the insert being placed as close to the platform as possible. The arm 49 is then pivoted by way of the lever 48 so that the knocker plates 53 and 54 impact against the holder 58 to thereby dislodge the vane and allow it to be slid out of the casing T-slot 22. The adjacent vanes are then successively removed in the same manner until the bottom of the case is reached, and then the procedure is reversed starting at the opposite split line flange until all of the vanes are removed from that stage. The pivot arm assembly may then be axially translated to the next stage which is to be removed using the same procedure and appropriate insert and holder.

While an exemplary embodiment has been depicted and described, it will be appreciated by those skilled in the art that the present invention is not limited thereto. For example, it will be appreciated that the present invention can be used with vane and casing structures not having a T-shaped slot 22 but rather a slot of a different shape. Further, the present invention may be used with compressor casing sectors which are greater or less than 180° sectors as shown. It will be further understood that the supporting structure does not necessarily have to straddle the casing sector as shown but may be of a different form such as a cantilevered structure.

Having thus described the invention, what is claimed as novel and desired to be secured by Letters Patent of the United States is:

1. An apparatus for removing a single turbomachinery vane and associated platform from a circumferential slot containing a plurality of vanes in an arcuate casing section comprising:

(a) support means for placement on the concave side of the casing;

(b) an elongate strike element having its one end pivotably supported by said support means on the axis of the casing and having on its free end a knocker element for imparting a dynamic impact against the single vane and away from the plurality of vanes with the resultant force being in a direction aligned with the plane of the circumferential slot to effect removal of the vane from the slot in a circumferential direction.

2. A turbomachinery vane removing apparatus as set forth in claim 1 wherein said knocker element extends axially outwardly on either side of the vane.

3. A turbomachinery vane removing apparatus as set forth in claim 2 wherein said free end is bifurcated to straddle the circumferential vane row.

4. A turbomachinery vane removing apparatus as set forth in claim 1 wherein said knocker element is placed adjacent the inner side of the vane platform.

5. A turbomachinery vane removing apparatus as set forth in claim 1 wherein said knocker element surrounds the airfoil portion of the vane.

6. A turbomachinery vane removing apparatus as set forth in claim 1 wherein said knocker element includes a holder and an insert disposed therein, said holder being adapted to receive the impact from said striker element and said insert being adapted to transmit the impact to the vane.

7. The turbomachinery vane removing apparatus as set forth in claim 6 wherein said insert surrounds the airfoil portion of the vane.

8. The turbomachinery vane removing apparatus as set forth in claim 6 wherein said insert is a cast element.

9. The turbomachinery vane removing apparatus as set forth in claim 1 wherein said support means includes an axle extending at least the length of the casing section.

10. The turbomachinery vane removing apparatus as set forth in claim 9 and including a pair of base elements straddling the length of said casing section for pivotably supporting said axle therebetween.

11. The turbomachinery vane removing apparatus as set forth in claim 10 wherein said pair of base elements are attached to the respective ends of said casing section.

12. The turbomachinery vane removing apparatus as set forth in claim 9 wherein said axle has attached thereto a lever for rotation thereof.

13. A method of removing a turbomachinery vane from an arcuate casing section comprising the steps of:

(a) placing a knocker element over the airfoil portion of the blade so that it extends radially outwardly on either side thereof to provide driving surfaces; and (b) imparting an impact to said driving surfaces in a generally tangential direction to move the vane circumferentially within the casing.

14. A method of removing a turbomachinery vane as set forth in claim 13 and including the preliminary step of casting a portion of said knocker element.

15. A method of removing a turbomachinery vane as set forth in claim 13 wherein said impact imparting step is accomplished by pivoting an elongate striker element about the axis of the casing.

* * * * *